US006425380B2

(12) United States Patent
Yamada et al.

(10) Patent No.: US 6,425,380 B2
(45) **Date of Patent: *Jul. 30, 2002**

(54) CANISTER FOR EVAPORATED FUEL TREATMENT APPARATUS

(75) Inventors: Hideo Yamada, Nagoya; Takashi Ishikawa, Okazaki, both of (JP)

(73) Assignees: Aisan Kogyo Kabushiki Kaisha, Ohbu; Toyota Jidosha Kabushiki Kaisha, Toyota, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/301,765

(22) Filed: Apr. 29, 1999

(30) Foreign Application Priority Data

Apr. 30, 1998 (JP) ..... 10-119837

(51) Int. Cl.[7] ..... F02M 37/04
(52) U.S. Cl. ..... 123/519; 123/516
(58) Field of Search ..... 123/516, 518, 123/519, 520, 521, 198 D

(56) References Cited

U.S. PATENT DOCUMENTS

| | | | | | |
|---|---|---|---|---|---|
| 2,323,525 | A | * | 7/1943 | Ebel | 123/516 |
| 3,610,220 | A | * | 10/1971 | Yamada | 123/518 |
| 3,675,634 | A | * | 7/1972 | Tatsutomi | 123/519 |
| 3,683,597 | A | * | 8/1972 | Beveridge | 123/519 |
| 3,685,504 | A | * | 8/1972 | Torazza | 123/519 |
| 3,727,597 | A | * | 4/1973 | Hensler | 123/519 |
| 4,003,358 | A | * | 1/1977 | Tatsutomi | 123/518 |
| 4,024,848 | A | * | 5/1977 | Lee | 123/516 |
| 4,168,687 | A | * | 9/1979 | Kurahashi | 123/516 |
| 4,658,796 | A | | 4/1987 | Yoshida et al. | |

FOREIGN PATENT DOCUMENTS

| | | |
|---|---|---|
| JP | 63-102960 | 7/1988 |
| JP | 63-104659 | 7/1988 |
| JP | 2-20771 | 2/1990 |
| JP | 4-311661 | 11/1992 |
| JP | 6-307306 | 11/1994 |

* cited by examiner

*Primary Examiner*—Carl S. Miller
(74) *Attorney, Agent, or Firm*—Pillsbury Winthrop LLP

(57) ABSTRACT

In order to make a fuel in a vapor phase from a fuel tank to be easily liquefied in a liquid trap, reduce an amount of a gasoline vapor entering from the liquid trap to a diffusion of a canister and extend a service life of an activated carbon, in accordance with a canister for an evaporated fuel treatment apparatus, a fuel in a vapor phase from a fuel tank (24) enters into a liquid trap (21A) from an evaporated fuel passage (23) via a tank port (13A). Since an inner diameter of a canister communication port (22A) is small, an invasion of a gasoline vapor from the liquid trap (21A) to a first diffusion (12) is restricted, so that a liquefaction in the liquid trap (21A) is promoted. When the fuel tank (24) is cooled and an internal pressure of the tank becomes a negative pressure, a fuel in a liquid phase in the liquid trap (21A) flows backward so as to prevent a lot of fuel in a liquid phase from being collected within the liquid trap (21A).

21 Claims, 7 Drawing Sheets

CANISTER FOR EVAPORATED FUEL TREATMENT APPARATUS

BACKGROUND OF THE INVENTION

1. Field of the Invention

The invention relates to a canister for an evaporated fuel treatment apparatus which collects a fuel evaporated, for example, from a fuel tank in an internal combustion engine and discharges the collected fuel to an intake system.

2. Description of the Related Art

There is disclosed in U.S. Pat. No. 4,658,796 an evaporated fuel treatment apparatus structured such that only a vapor phase fuel can be introduced to an adsorbent in a canister by arranging a liquid trap for separating a gasoline vapor into a vapor phase and a liquid phase on a passage extending from a tank port communicated with a fuel tank to the adsorbent, thereby preventing the adsorbent from deteriorating due to an attachment of a component having a high boiling point of the liquid phase fuel to the adsorbent.

The apparatus is structured, as shown in FIG. 9, such that a second partition wall 20 having both ends extending to a casing 11 is arranged between an opening portion of a tank port 13, mounted on the casing of a canister 2, into the casing and a first diffusion chamber 12 on an inlet side of the canister so as to form a liquid trap 21, and the tank port 13 is opened between the liquid trap 21 and the casing 11. A first passage 22 for communicating the liquid trap 21 with the first diffusion chamber 12 is provided in the second partition wall 20. A fuel in a liquid phase flowing into the canister at a time of a sudden turn of a vehicle is supplied to the liquid trap 21, and only the fuel in a vapor phase flows into the first diffusion chamber 12 via the first passage 22 and is diffused at the first diffusion chamber so as to collect the fuel with the adsorbent 10.

Further, with respect to the fuel in a liquid phase collected in a lower portion within the liquid trap 21, air out of the canister 2 rises in temperature to evaporate the liquid phase fuel and the adsorbent 10 adsorbs the fuel via the first passage 22.

The fuel in a vapor phase flows into a third diffusion chamber 15 from a carburetor float chamber (not shown) after passing through a passage opening/closing valve which is opened when an engine is stopped and further passing through an outer bent port 19 of the canister 2, and is diffused so as to collect the fuel with the adsorbent 10.

A second diffusion chamber 14 on an outlet side of the canister 2 is provided between the adsorbent 10 and a lower end of the casing 11, and is communicated with the atmosphere by a first atmosphere port 18 provided in the casing 11.

A purge port 17 communicated with an intake passage (not shown) is open to the first diffusion chamber 12 on the inlet side of the canister separated from a third diffusion chamber 15 by a first partition wall 16 having an end buried in the adsorbent 10.

In accordance with the conventional technique mentioned above, since a position of a lowermost end of the tank port 13 and a position of an upper end of the first passage 22 communicated with the first diffusion chamber 12 receiving the adsorbent 10 therein are close to each other, a distance between the both is short and diameters of the tank port 13 and the first passage 22 are substantially the same, it is hard that the fuel in a vapor phase is liquefied in the liquid trap 21, so that the fuel in a vapor phase enters into the first diffusion chamber 12 from the first passage 22 without changing it to the liquid phase so as to be adsorbed to an activated carbon 10 as the adsorbent. Accordingly, there has been a problem that a performance of the activated carbon is deteriorated. Further, since the position of the lower end of the tank port 13 is disposed above the liquid trap 21, there is a little effect that the fuel in a liquid phase flows backward due to a negative pressure within the tank when the fuel tank is cooled, so that the fuel in a liquid phase is easily collected in the liquid trap 21. When a lot of fuel in a liquid phase is collected in the liquid trap 21, the fuel in the vapor phase enters into the first diffusion chamber 12 from the first passage 22 without being separated into the vapor phase and the liquid phase so as to be adsorbed to the activated carbon 10. Accordingly, in this view, there has been a problem that a performance of the activated carbon is deteriorated.

SUMMARY OF THE INVENTION

An object of the present invention is to provide a canister for an evaporated fuel treatment apparatus which can solve the problems mentioned above.

In order to solve the object mentioned above, in accordance with the present invention, there is provided a canister for an evaporated fuel treatment apparatus comprising a liquid trap for separating a gasoline vapor generated from the tank into the vapor phase and the liquid phase, wherein a tank port connected to the tank is arranged in a lower end portion of the liquid trap, an opening portion of a canister communication passage communicated with a diffusion chamber having an adsorbent is arranged in an upper portion within the liquid trap, and an inner diameter of the canister communication passage is set to be smaller than an inner diameter of the tank port.

In general, when the fuel tank is not cooled and the evaporated fuel is rich, the fuel in a vapor phase in a pipe between the tank and the canister is pressurized in a direction of the canister due to a pressure of evaporation. Then, the fuel in a vapor phase introduced into the liquid trap is cooled so as to become a liquid phase. In accordance with this structure of the present invention, a fuel in a liquid phase corresponding to a difference between the position of the lower end of the tank port and the position of the opening portion of the canister communication passage can be collected in the liquid trap. Further, when the fuel tank is cooled and the inner portion of the tank is in a negative pressure state, the fuel in a liquid phase within the liquid trap flows backward, so that the fuel in a liquid phase is not continuously collected within the separation chamber.

Further, since the inner diameter of the canister communication passage is smaller than the inner diameter of the tank port, the pressure of the fuel in a vapor phase increases within the liquid trap so as to be easily liquefied. As a result, an amount of the fuel in a vapor phase adsorbed to the adsorbent is reduced, so that a life of the adsorbent is extended.

DESCRIPTION OF THE PREFERRED EMBODIMENT

Next, a preferred embodiment in accordance with the present invention will be described below with reference to the accompanying drawings.

[First Embodiment]

Figure 1:
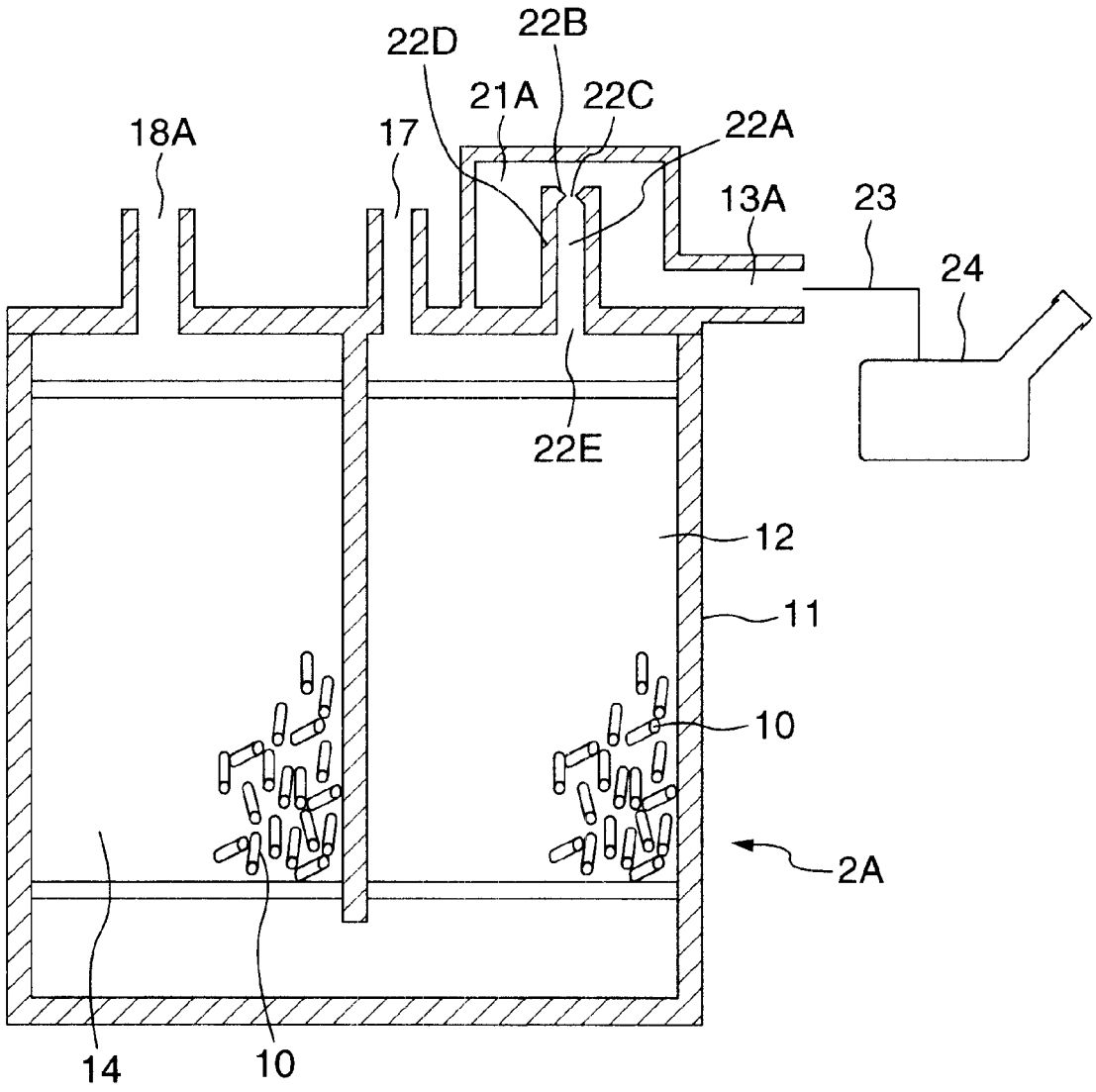
FIG. 1 is a vertical cross sectional view of a first embodiment in accordance with a canister for evaporated fuel treatment apparatus of the present invention.

A first embodiment in FIG. 1 shows a vertical-placed type integrated canister in which a liquid trap 21A is arranged on a first diffusion chamber 12, and an activated carbon 10 as an adsorbent is received in the first diffusion chamber 12 and a second diffusion chamber 14 in a casing of a canister 2A. Reference numeral 21A denotes a liquid trap integrally constructed with the casing 11, and a tank port 13A communicated with a lower end portion thereof is communicated with an upper vapor chamber in a gasoline fuel tank 24 via an evaporated fuel passage 23. It is preferable to set a position of an opening of the tank port 13A to the liquid trap 21A as low as possible in the liquid trap 21A, and it is preferable to structure such that a lowermost end of the liquid trap 21A is communicated with the tank port 13A, as shown in FIG. 1.

In accordance with the structure mentioned above, the fuel in a liquid phase in the liquid trap 21A easily flows backward to the tank when an internal pressure of the fuel tank becomes a negative pressure, so that the fuel in a liquid phase is not continuously collected in the liquid trap 21A at a large amount.

An upper portion of the liquid trap 21A is communicated with the first diffusion chamber 12 via a canister communication passage 22A, and a throttle portion 22C is formed at an opening portion 22B in the canister communication passage 22A to the liquid trap 21A, and the an inner diameter of the throttle portion 22C is defined to be smaller than an inner diameter of the tank port 13A. It is preferable to set a position of the opening portion 22B of the canister communication passage 22A to the liquid trap 21A as high as possible in the liquid trap 21A, and it is preferable to structure such that an uppermost portion of the liquid trap 21A is communicated with the canister communication passage 22A, as shown in FIG. 1.

In accordance with the structure mentioned above, the pressure within the liquid trap 21A increases and the fuel in a vapor phase is easily liquefied, so that an amount of the gasoline vapor entering into the adsorbent in the first diffusion chamber 12 is reduced.

Further, the canister communication passage 22A is formed by a pipe 22D provided upright from a substantially center portion of the liquid trap 21A.

The first diffusion chamber 12 is communicated with a well-known intake passage from the purge port 17 via an evaporated fuel passage (not shown). The second diffusion chamber 14 is communicated with the atmosphere by an atmosphere port 18A.

Incidentally, the above throttle portion 22C may be provided on the opening portion side 22E to the first diffusion chamber 12.

[Second Embodiment]

Figure 2:
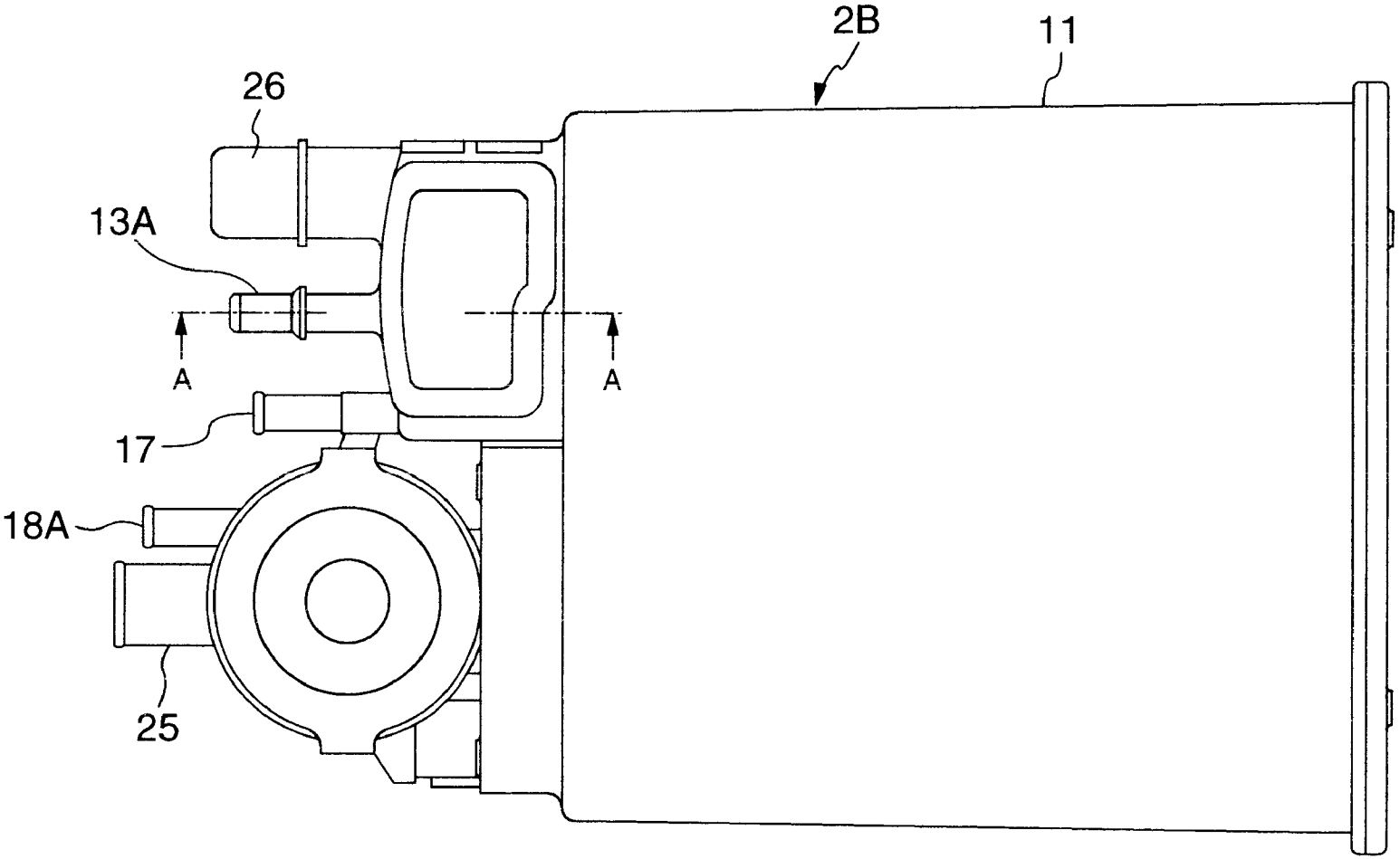
FIG. 2 is a front elevational view of a second embodiment in accordance with a canister for evaporated fuel treatment apparatus of the present invention.
Figure 3:
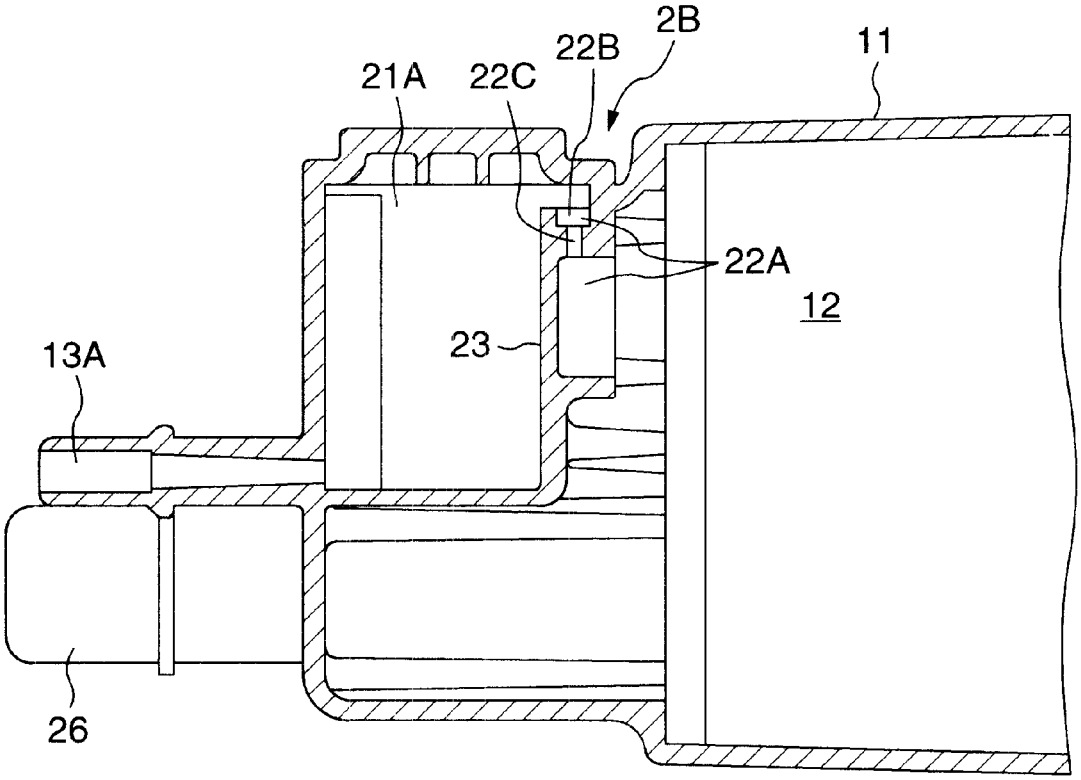
FIG. 3 is a cross sectional view along a line A—A in FIG. 2, which shows a main portion of the second embodiment in accordance with the present invention.

A second embodiment shown in FIGS. 2 and 3 is formed by applying the present invention to a horizontal-placed type integrated canister 2B, in which a liquid trap 21A is arranged on a side of a first diffusion chamber 12, and in which a detailed shape and a size thereof are different from those of the first embodiment shown in FIG. 1, however, a structure and an operation thereof are basically the same. That is, in the canister communication passage 22A communicated with the first diffusion chamber 12, the opening portion 22B is disposed to the upper portion of the liquid trap 21A in the same manner as that of the first embodiment, and the tank port 13A is communicated with the lowermost end of the liquid trap 21A. In this case, the same reference numerals are attached to the same elements as those mentioned above.

Further, the canister communication passage 22A in the second embodiment is formed in a defining wall portion 23 separating the first diffusion chamber 12 and the liquid trap 21A, and has a throttle portion 22C.

Still further, actually, in this second embodiment, an inner diameter of the throttle portion 22C in the canister communication passage 22A is set to 1.5 mm and an inner diameter of the tank port 13A is set to 3.5 mm. In this case, reference numeral 25 denotes a drain port. Reference numeral 26 denotes an ORVR (Onboard Refueling Vapor Recovery) inlet port, of which one end is communicated with the upper vapor chamber of the fuel tank, and another end is communicated with the first diffusion chamber 12, for collecting much vapor temporarily caused in the fuel tank during the fuel supplying. Therefore, the inner diameter of the ORVR inlet port is made larger than that of the tank port 13A.

[Third Embodiment]

Figure 4:
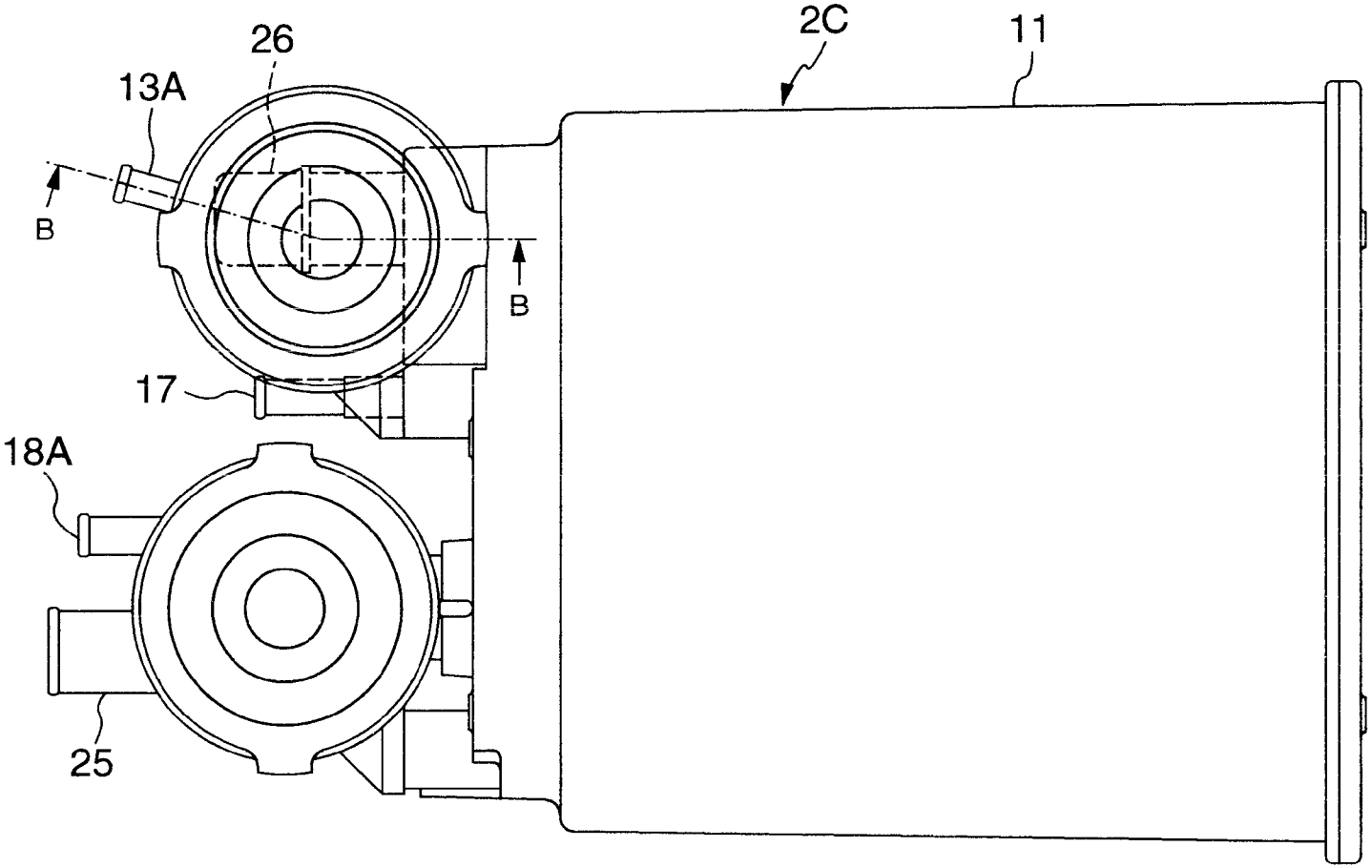
FIG. 4 is a front elevational view of a third embodiment in accordance with a canister for evaporated fuel treatment apparatus of the present invention.
Figure 5:
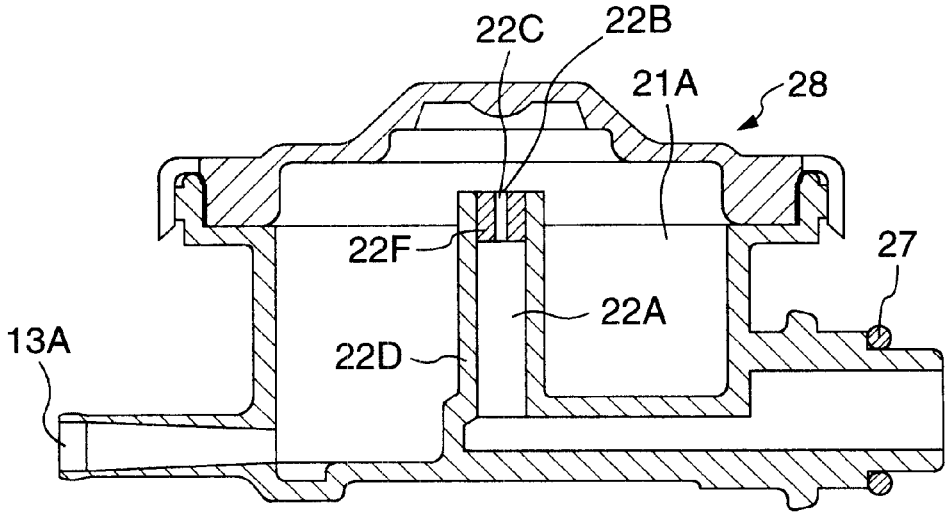
FIG. 5 is a cross sectional view along a line B—B in FIG. 4, which shows a main portion of the third embodiment in accordance with the present invention.
Figure 6:
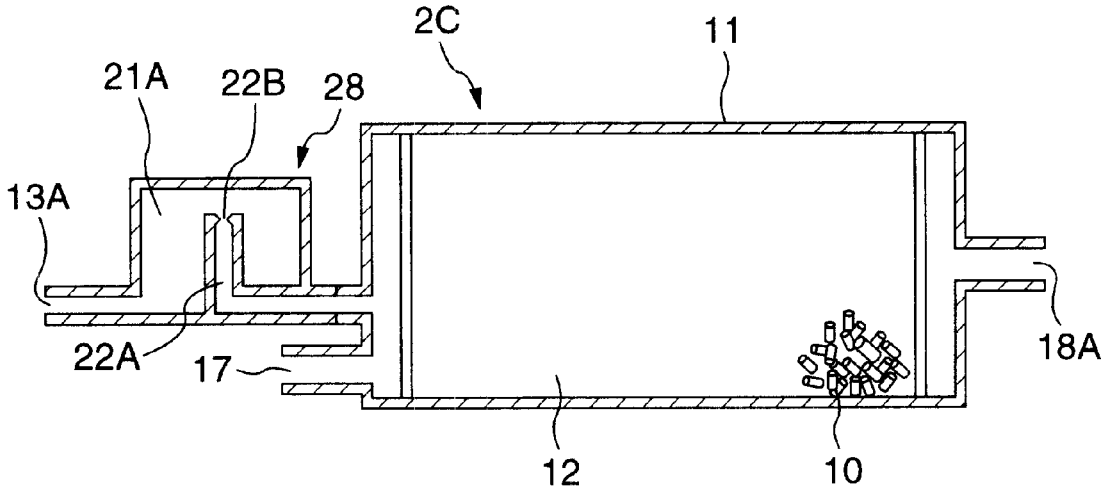
FIG. 6 is a schematically vertical cross sectional view of the third embodiment in accordance with a canister for evaporated fuel treatment apparatus of the present invention.

A third embodiment shown in FIGS. 4, 5 and 6 shows an example in which the present invention is applied to a horizontal-placed separated canister, and which is structured such that a liquid trap assembly 28 formed separately from a casing 11 of a canister 2C is connected to the casing 11 via an O ring 27, and a liquid trap 21A is formed within the liquid trap assembly 28.

Here, also in this embodiment, the canister communication passage 22A and the tank port 13A are structured such as to achieve the same operation as that of the embodiment mentioned above, that is, in the canister communication passage 22A communicated with the first diffusion chamber 12, an opening portion 22B thereof is disposed to the upper portion of the liquid trap 21A in the same manner as that of the first embodiment mentioned above and the tank port 13A is communicated with the lowermost end of the liquid trap 21A.

Further, the canister communication passage 22A is formed by a pipe 22D provided upright, and a throttle member 22F is fit in and secured to the opening portion 22B to the liquid trap 21A, by which throttle member 22F a throttle portion 22C is formed.

Still further, in the third embodiment, an ORVR inlet port 26 is also provided as similarly to the above.

In this case, the same reference numerals are attached to the elements serving the same operations as those mentioned above and an explanation thereof will be omitted.

[Fourth embodiment]

Figure 7:
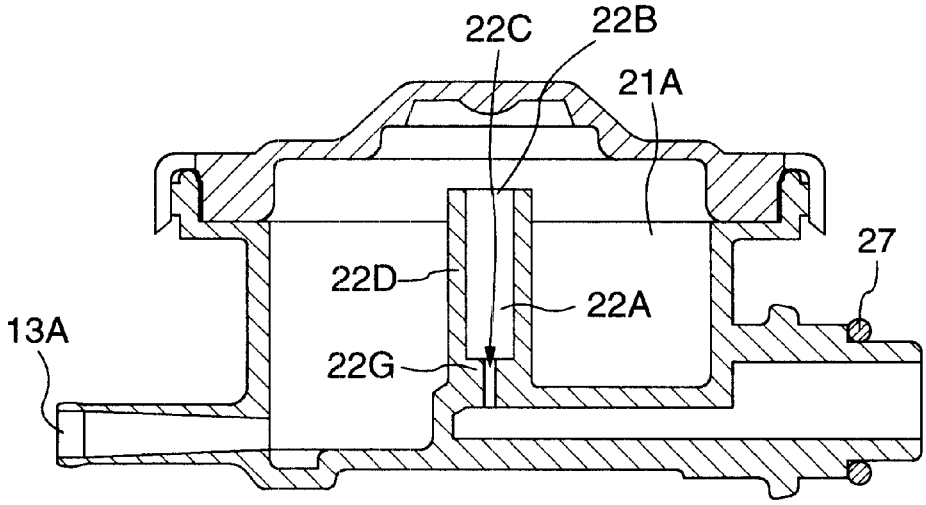
FIG. 7 is a vertical cross sectional view of a liquid trap assembly in a fourth embodiment according to a canister for evaporated fuel treatment apparatus of in the present invention.
Figure 8:
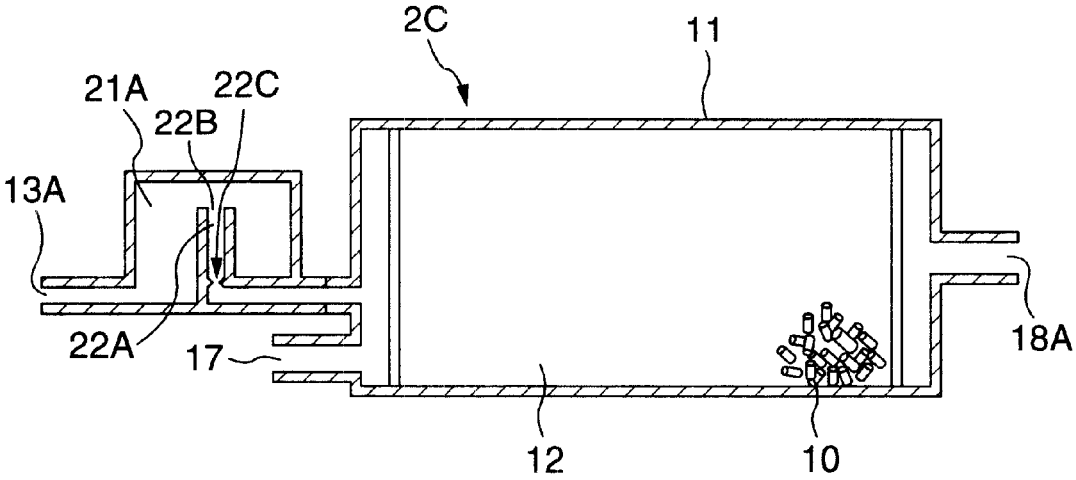
FIG. 8 is a schematically vertical cross sectional view of the fourth embodiment in a canister for evaporated fuel treatment apparatus of the present invention.
Figure 9:
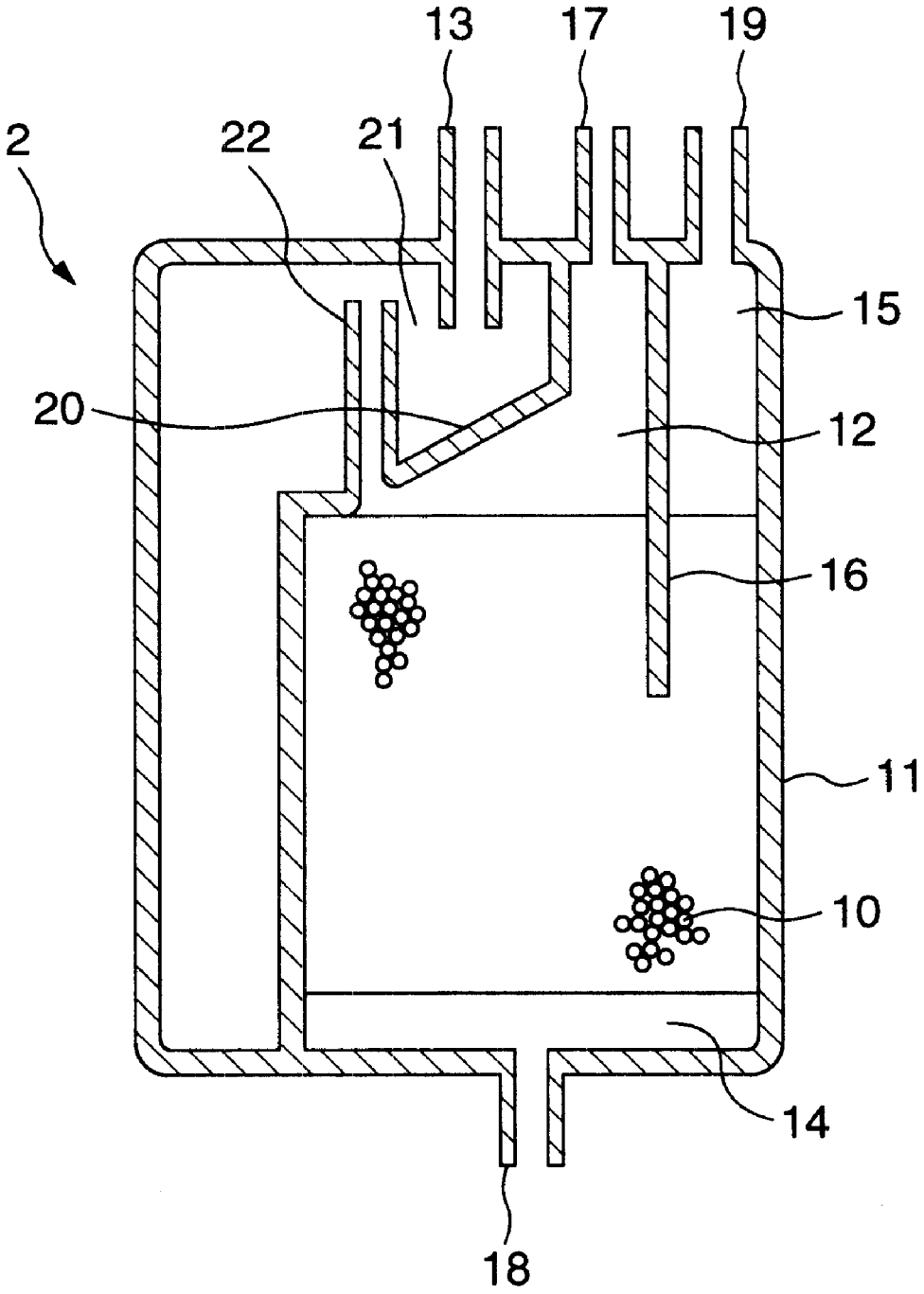
FIG. 9 is a vertical cross sectional view of a canister for evaporated fuel treatment apparatus in a conventional art.

A fourth embodiment, shown in FIGS. 7 and 8, is a modification of the embodiment shown in FIGS. 4 to 6, in which a bottom wall portion 22G is integrally formed at a lower portion of a pipe 22D forming the canister communication passage 22A, and in the bottom wall portion 22G, a throttle portion 22C having the same diameter as the throttle portion 22C shown in FIG. 5 is formed by perforation in a vertical direction. Incidentally, the opening portion 22B at the upper end of the canister communication passage 22A is disposed to the upper portion of the liquid trap 21A, similarly to the above-mentioned.

The fourth embodiment can also achieve the same function and effect as those in the third embodiment. Further, in the fourth embodiment, by forming the throttle portion 22C at the lower end of the canister communication passage 22A, when forming the throttle portion integrally with the canister communication passage, removal of the dies is facilitated after forming the canister communication passage 22A and the throttle portion 22C.

Incidentally, in the above embodiments, the opening portion 22B in the canister communication passage 22A to the liquid trap 21A is open in the upward direction, but the opening portion may be open in a sideward direction.

Further, in the above embodiments, the throttle portion 22C having a diameter smaller than that of the tank port is formed at one portion in the canister communication passage 22A, but the canister communication passage may have a total length with an inner diameter smaller than that of the tank port.

Since the canister for the evaporated fuel treatment apparatus in accordance with the present invention is structured in the manner mentioned above, the fuel in a liquid phase within the liquid trap easily flows backward to the tank when the fuel tank is cooled and the internal pressure of the tank becomes a negative pressure, thereby preventing the fuel in a liquid phase from being a continuously collected within the liquid trap to a large amount.

Further, the pressure within the liquid trap is increased and the fuel in a vapor phase is easily liquefied, so that there is an advantage that an amount of the gasoline vapor entering into the adsorbent in the first diffusion chamber is reduced.

What is claimed is:

1. A canister for an evaporated fuel treatment apparatus, comprising:

a casing provided with a diffusion chamber containing an adsorbent; and a liquid trap for separating a gasoline vapor generated from a fuel tank into a vapor phase and a liquid phase, wherein a tank port connected to the tank is arranged in a horizontal direction in a lower end portion of the liquid trap, an opening portion of a canister communication passage communicated with said diffusion chamber is arranged in an upper portion within the liquid trap, and an inner diameter of at least one portion in the canister communication passage is set to be smaller than an inner diameter of the tank port.

2. A canister for an evaporated fuel treatment apparatus according to claim 1, wherein said canister communication passage is made of a pipe, a throttle portion being provided in said pipe.

3. A canister for an evaporated fuel treatment apparatus according to claim 2, wherein said pipe of said canister communication passage is an upright state, a throttle member being fit into and secured to an upper portion of said pipe so as to form said throttle portion.

4. A canister for an evaporated fuel treatment apparatus according to claim 2, wherein said pipe of said canister communication passage is an upright state, a throttle portion being formed in a lower portion of said pipe.

5. A canister for an evaporated fuel treatment apparatus according to claim 1, wherein said liquid trap and said casing are integrally formed.

6. A canister for an evaporated fuel treatment apparatus according to claim 5, wherein said canister communication passage is made of a pipe, a throttle portion being provided in said pipe.

7. A canister for an evaporated fuel treatment apparatus according to claim 6, wherein said pipe of said canister communication passage is an upright state, a throttle member being fit into and secured to an upper portion of said pipe so as to form said throttle portion.

8. A canister for an evaporated fuel treatment apparatus according to claim 6, wherein said pipe of said canister communication passage is an upright state, a throttle portion being formed in a lower portion of said pipe.

9. A canister for an evaporated fuel treatment apparatus according to claim 1, further comprising a liquid trap assembly including said liquid trap, wherein said liquid trap is arranged on a side of said casing, said liquid trap assembly being formed to have said liquid trap therein and to separate from said casing which forms said diffusion chamber, and said liquid trap assembly being adapted to communicate with said casing.

10. A canister for an evaporated fuel treatment apparatus according to claim 9, wherein said canister communication passage is made of a pipe, a throttle portion being provided in said pipe.

11. A canister for an evaporated fuel treatment apparatus according to claim 10, wherein said pipe of said canister communication passage is an upright state, a throttle member being fit into and secured to an upper portion of said pipe so as to form said throttle portion.

12. A canister for an evaporated fuel treatment apparatus according to claim 10, wherein said pipe of said canister communication passage is an upright state, a throttle portion being formed in a lower portion of said pipe.

13. A canister for an evaporated fuel treatment apparatus according to claim 5, wherein said liquid trap is arranged on a side of said casing.

14. A canister for an evaporated fuel treatment apparatus according to claim 5, wherein said liquid trap is arranged on an upper portion of said casing.

15. A canister for an evaporated fuel treatment apparatus, comprising:

a casing provided with a diffusion chamber containing an adsorbent; and a liquid trap for separating a gasoline vapor generated from a fuel tank into a vapor phase and a liquid phase, wherein a tank port connected to the tank is arranged in a lower end portion of the liquid trap, an opening portion of a canister communication passage communicated with said diffusion chamber is arranged in an upper portion within the liquid trap, and an inner diameter of at least one portion in the canister communication passage is set to be smaller than an inner diameter of the tank port, wherein said liquid trap and said casing are integrally formed, and wherein said canister communication passage is made of a pipe, and wherein a throttle portion is provided in said pipe.

16. A canister for an evaporated fuel treatment apparatus according to claim 15, wherein said pipe of said canister communication passage is generally vertically oriented, and wherein a throttle member is fit into and secured to an upper portion of said pipe so as to form said throttle portion.

17. A canister for an evaporated fuel treatment apparatus according to claim 15, wherein said pipe of said canister communication passage is generally vertically oriented, and wherein a throttle portion is formed in a lower portion of said pipe.

18. A canister for an evaporated fuel treatment apparatus according to claim 13, wherein said canister communication passage is formed in a defining wall portion separating said diffusion chamber and said liquid trap, and a throttle portion is formed on one portion of said canister communication passage.

19. A canister for an evaporated fuel treatment apparatus according to claim 13, wherein said canister communication passage is made of a pipe, a throttle portion being provided in said pipe.

20. A canister for an evaporated fuel treatment apparatus according to claim 19, wherein said pipe of said canister communication passage is generally vertically oriented, a throttle member being fit into and secured to an upper portion of said pipe so as to form said throttle portion.

21. A canister for an evaporated fuel treatment apparatus according to claim 19, wherein said pipe of said canister communication passage is generally vertically oriented, a throttle portion being formed in a lower portion of said pipe.

* * * * *